US008431848B2

(12) United States Patent
Bruchal

(10) Patent No.: US 8,431,848 B2
(45) Date of Patent: Apr. 30, 2013

(54) PRESSURE SWITCH

(75) Inventor: Brian Bruchal, Edmonton (CA)

(73) Assignee: Argus Machine Co., Ltd., Edmonton (CA)

( * ) Notice: Subject to any disclaimer, the term of this patent is extended or adjusted under 35 U.S.C. 154(b) by 317 days.

(21) Appl. No.: 12/868,664

(22) Filed: Aug. 25, 2010

(65) Prior Publication Data

US 2012/0048710 A1 Mar. 1, 2012

(51) Int. Cl.
*H01H 35/24* (2006.01)

(52) U.S. Cl.
USPC ..... 200/82 R

(58) Field of Classification Search ..... 200/82 R, 200/81 R, 83 R, 83 J, 82 B, 82 C; 361/676
See application file for complete search history.

(56) References Cited

U.S. PATENT DOCUMENTS

| | | | | |
|---|---|---|---|---|
| 4,007,343 | A | 2/1977 | Alten | |
| 4,500,759 | A * | 2/1985 | deFasselle et al. | 200/81.9 R |
| 4,890,502 | A * | 1/1990 | Elias et al. | 73/864.85 |
| 5,242,011 | A * | 9/1993 | Hesse | 165/283 |
| 5,554,834 | A | 9/1996 | Ellett | |
| 5,670,766 | A | 9/1997 | Ellett | |
| 5,744,771 | A | 4/1998 | Ellett | |
| 7,351,926 | B2 * | 4/2008 | Hillman | 200/81 R |
| 7,837,496 | B1 * | 11/2010 | Pal | 439/485 |
| 2010/0037697 | A1 | 2/2010 | Weiss | |

FOREIGN PATENT DOCUMENTS

CA 2 189 608 C 2/2004

OTHER PUBLICATIONS

"SKL High Temperature Pressure Transmitter With Cooling Fins," Product Information, ADZ NAGANO Sensortechnik, ADZ NAGANO GmbH, Ottendorf-Okrilla, Germany, <http://www.adz.de/pressure-transmitter.html>, cited in a Canadian Examination Report dated Dec. 17, 2012, 4 pages.

* cited by examiner

*Primary Examiner* — Xuong Chung Trans
(74) *Attorney, Agent, or Firm* — Christensen O'Connor Johnson Kindness PLLC

(57) ABSTRACT

A pressure switch is disclosed, comprising: a spool forming a pressure sensitive end; an actuating rod extended into the spool and slidable over a limited range within the pressure switch under external fluid pressure on the pressure sensitive end; a switch housing containing a switch operatively connected to the actuating rod; and a cylindrical connector terminating in a first axial end and a second axial end, the cylindrical connector being threaded into the spool at the first axial end and into the switch housing at the second axial end. A pressure switch is also disclosed comprising: a housing defining an interior bore that terminates in a pressure sensitive end of the housing; an actuating rod slidable over a limited range within the interior bore under external fluid pressure on the pressure sensitive end; a switch, within the housing, operatively connected to the actuating rod; and outwardly extending fins mounted on the housing.

8 Claims, 2 Drawing Sheets

PRESSURE SWITCH

TECHNICAL FIELD

This invention relates to pressure switches.

BACKGROUND

In the design of pressure switches, a rod slidable within a housing and movable by changes in external fluid pressure operates a plunger of a mechanically operated electrical switch. Resistance of the rod to movement, and hence the pressure at which the switch trips, is adjusted by a spring within the pressure switch that is biased against movement of the rod due to external fluid pressure. Adjustment of the compression on the spring changes the tripping pressure, which for example may be set at 500 psi. Often the interior of the switching housing cannot exceed a certain temperature, but the switch may need to be used in high temperature environments. There is a need for a high temperature operating pressure switch.

SUMMARY

A pressure switch is disclosed, comprising: a spool forming a pressure sensitive end; an actuating rod extended into the spool and slidable over a limited range within the pressure switch under external fluid pressure on the pressure sensitive end; a switch housing containing a switch operatively connected to the actuating rod; and a cylindrical connector terminating in a first axial end and a second axial end, the cylindrical connector being threaded into the spool at the first axial end and into the switch housing at the second axial end.

A pressure switch is also disclosed comprising: a housing defining an interior bore that terminates in a pressure sensitive end of the housing; an actuating rod slidable over a limited range within the interior bore under external fluid pressure on the pressure sensitive end; a switch, within the housing, operatively connected to the actuating rod; and outwardly extending fins mounted on the housing.

A pressure switch is also disclosed comprising: a housing defining an interior bore that terminates in a pressure sensitive end of the housing; an actuating rod slidable over a limited range within the interior bore under external fluid pressure on the pressure sensitive end; a switch, within the housing, operatively connected to the actuating rod; and a heat insulating spacer at least partially surrounding the actuating rod within the internal bore.

A pressure switch is also disclosed comprising: a spool forming a pressure sensitive end; an actuating rod extended into the spool and slidable over a limited range within the pressure switch under external fluid pressure on the pressure sensitive end; a switch housing containing a switch operatively connected to the actuating rod; a cylindrical connector terminating in a first axial end and a second axial end, the cylindrical connector being threaded into the spool at the first axial end and into the switch housing at the second axial end; outwardly extending fins mounted on the cylindrical connector; and a heat insulating spacer at least partially surrounding the actuating rod within an interior bore of the pressure switch.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 1:
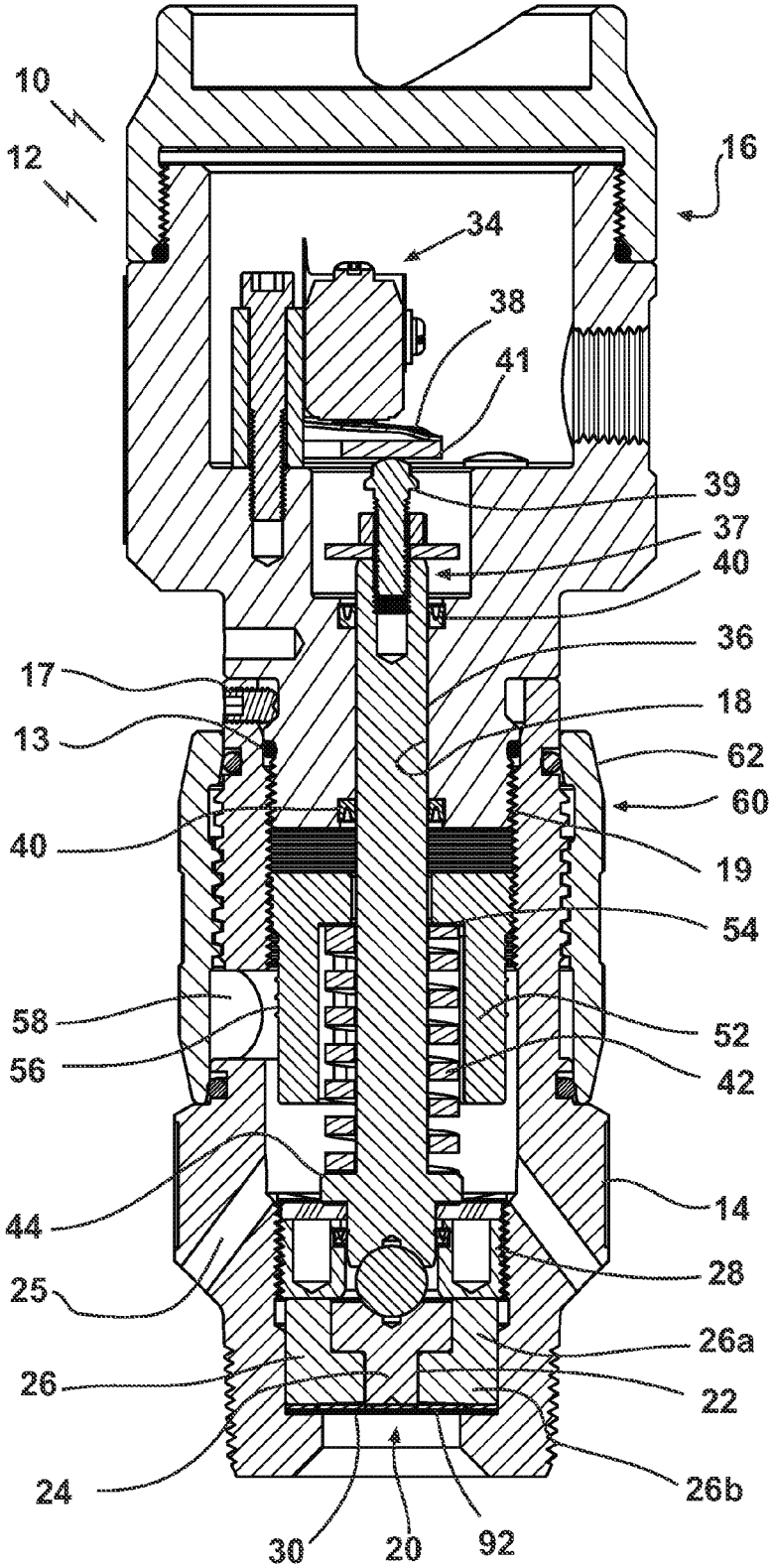
Fig. 1 Prior Art
FIG. 1 is a side elevation view, in section, of a pressure switch.

A pressure switch made by Argus Machine Co. Ltd. of Edmonton, Alberta, Canada, is illustrated in FIG. 1, which shows a longitudinal section of a pressure switch 10. Pressure switch 10 may be formed of a spool 14, a switch housing 16, and an actuating rod 36. The pressure switch 10 may be formed of a housing 12 comprising spool 14 and switch housing 16. Spool 14 and switch housing 16 may be threaded together and sealed with seal 13. Set screw 17 may lock the spool 14 and switch housing 16 of the housing together. An interior bore 18, for example of variable inner diameter, may pass through the housing 12 from the spool 14 to the switch housing 16.

Spool 14 may form a pressure sensitive end 20. Actuating rod 36 may be extended into the spool 14 and slidable over a limited range within the pressure switch 10 under external fluid pressure on the pressure sensitive end 20. In the bore 18 at the pressure sensitive end 20 may be a piston 22 that is free to move longitudinally a limited amount within the bore 18. The piston 22 is shown here as including a piston head 24 snugly fitted in piston guide 26 at the pressure sensitive end 20 of the housing 12. The piston guide 26 may be formed in 10 two portions or pieces (for example upper portion **26*a* and lower portion 26*b*) and may be secured within the housing by a locking nut 28 threaded in the spool of the housing 12. Laterally extending slots 25 in the spool 14 may allow for draining of fluid from within the interior space of spool 14. Two of the slots 25 are shown, and four may be present. The other two may be at right angles to the section of FIG. 1. End 20 is sealed, for example by diaphragm 30 that is held firmly within the end 20 by the piston guide 26 and housing 12 and sealed with a gasket or a suitable alternative such as a seal ring. A support disc 92 may be interposed between the diaphragm 30 and piston 22 to assist in supporting the diaphragm 30 against collapse from external fluid pressure. Range of movement of the piston may be limited by shoulders on the piston guide 26 and by shoulders on the piston 22**.

A switch 34, for example a mechanically operated electrical switch or micro-switch may be operatively connected to the actuating rod 36 and contained within the switch housing 16 of the housing 12. Switch 34 may be connected to rod 36 directly, indirectly, or may not be physically connected. For example, switch 34 may merely detect rod 36 movement using a magnetic field, or by sufficient spacing between a switch end 37 of rod 36 and switch 34 such that switch 34 is only contacted when the switch end 37 is at full extension. Contact may include completing an electrical circuit. Actuating rod 36 may be mounted slidably within the housing 12 to extend between the piston 22 and the mechanically operated electrical switch 34. For example, the rod 36 may be operatively connected to both the piston 22 and the switch 34 by connection between the piston 22 and a resilient spring arm 38 of the switch 34, but this operative connection may be accomplished using intervening devices, with added complexity for example. Alternatively, no direct contact may be necessary, for example if magnetic or other connections are used. The diaphragm 30, piston 22 and rod 36 function as a mechanism to transfer external fluid pressure along rod 36 to the mechanically operated electrical switch 34. The mechanically operated electrical switch 34 may be operated by resilient spring arm 38, which abuts, through connector 41, against hub 39 threaded onto the end 37 of rod 36. Movement of the rod 36 and hub 39 in the direction from the spool of the housing 12 to the switch housing may depress the resilient spring arm 38 and 10 activate the switch 34. The end 37 of the rod 36 may be sealed within the bore 18 by elastomer seals 40.

A biasing device, such as a spring 42, may be connected to rod 36 to bias rod 36 against external fluid pressure. For example, spring 42 may be disposed about the rod 36 between a first stop 44 on the rod 36 and a second stop 54 forming part of an adjustment sleeve 52. The spring 42 provides resistance against movement of the rod 36 from the spool 14 of the housing 12 to the switch housing 16 of the housing 12. The degree of resistance of the spring 42 to external fluid pressure on piston 22, hence movement of rod 36, is adjustable by adjustment sleeve 52 surrounding and thus engaging one end of the spring 42. The sleeve 52 may include a threaded portion 54 threaded into the bore 18 of the housing 12 at threads 19 for movement longitudinally within the housing 12 by rotation of the sleeve 52. Plural radially extending slots 56 may be disposed around the sleeve 52 and shaped to receive an implement, such as a screw driver, used to rotate the sleeve 52. A port 58 or opening in the housing 12 may be provided to make the adjustment sleeve 52 accessible, for example by a screwdriver or other means for operating the adjustment sleeve 52. A cover 60 for the port 58 may be provided by a ring 62 disposed around the housing 12 and threaded onto the housing 12 over the port 58.

Argus Machine Co. Ltd. currently manufacture and sell such Pressure Switches 10 designed for temperatures where the interior of the switching housing 16 cannot exceed a certain temperature, for example 180° F. This temperature may be governed by the maximum continuous operating temperature of the Micro Switch (switch 34). In house temperature testing, for example ambient room temperature 68° F. & still air, on a standard Pressure Switch 10 currently manufactured shows the internal temperature of the switch housing 16 may exceed 225° F. when the pressure sensitive end 20 of the bottom sub or spool 14 is heated to 600° F., which is the maximum temperature of steam used for enhanced oil recovery. At this elevated fluid temperature the reliability and life of the Micro Switch 34, found in the switch housing 16, is affected. Maximum operating temperature of the standard commercial Micro-Switch is 180° F.

Figure 2:
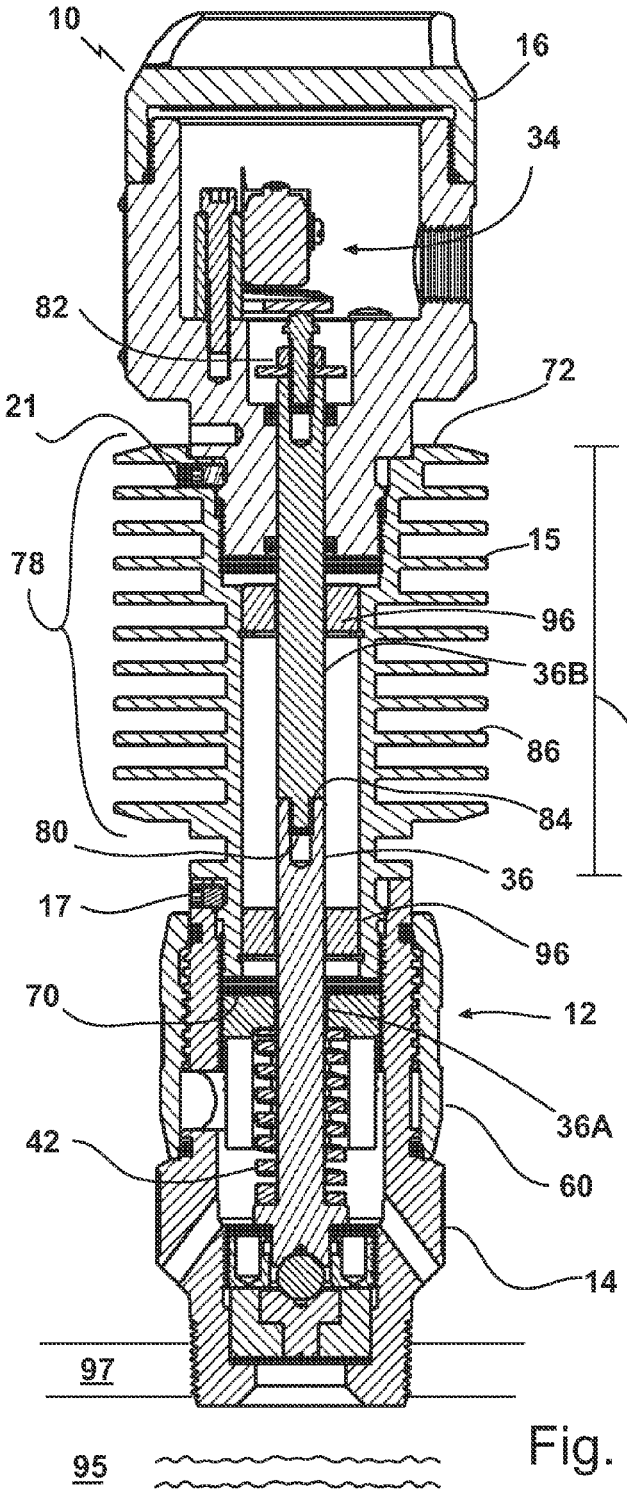
FIG. 2 is a side elevation view, in section, of a pressure switch made according to embodiments disclosed herein.
Figure 3:
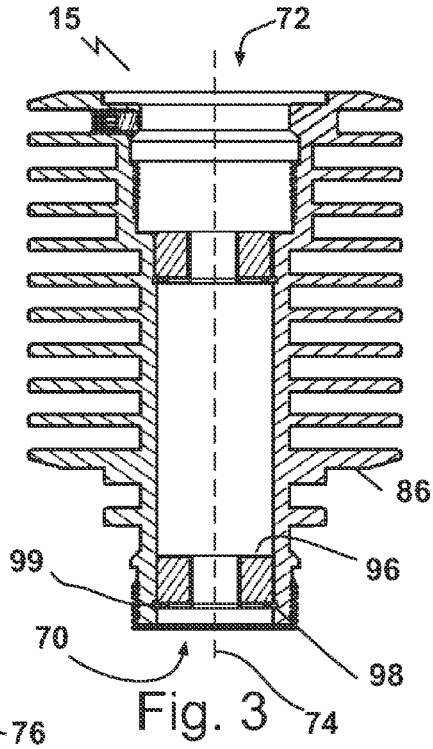
FIG. 3 is a side elevation view, in section, of a cylindrical connector for a pressure switch.

Referring to FIGS. 2 and 3, a cylindrical connector 15 for pressure switch 10 is illustrated. It should be understood that the pressure switch 10 shown in FIG. 2 operates under the same principles as the pressure switch 10 of FIG. 1. Connector 15 terminates in a first axial end 70 and a second axial end 72. Referring to FIG. 3, ends 70 and 72 are positioned at opposed ends of a theoretical cylinder axis 74 as shown. Referring to FIG. 2, the cylindrical connector 15 is threaded into the spool 14 at the first axial end 70 and into the switch housing 16 at the second axial end 72. As a separate part with threaded connections, connector 15 may be retrofitted into existing pressure switches 10 such as the one shown in FIG. 1. With the introduction of cylindrical connector 15, an effective extension of switch housing 16 is achieved, which may further achieve a decrease in the internal temperature of the switch housing 16 when pressure sensitive end 20 is under high fluid temperatures. Thus, the presence of connector 15 creates a separation between spool 14 and switch housing 16 that reduces heat transfer to switch housing 16 and increases the maximum fluid temperature that may be present at pressure sensitive end 20. Connector 15 may be secured to spool 14 and switch housing 16 by conventional means, such as set screws 17 and 21.

Figure 4:
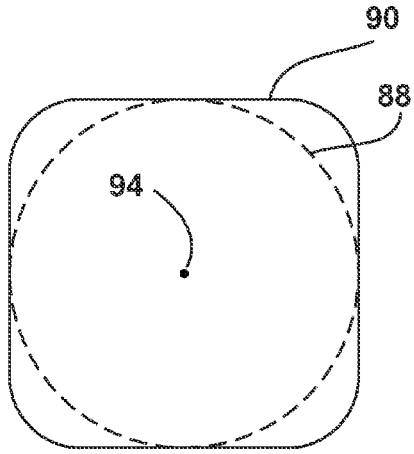
FIG. 4 is a top plan view of the pressure switch of FIG. 2, with the profile of the cylindrical connector overlaid in dotted lines.

Various aspects of connector 15 may be tailored to reduce heat transfer to switch 34, including aspects such as the effective longitudinal extension length 76, materials used to construct connector 15, and the external profile 78 of connector 15, inter alia. External profile 78 may be modified to operate as a heat sink, for example by mounting extended surfaces on connector 15. For example, outwardly extending fins 86 may be mounted on the cylindrical connector 15. Cooling fins 86, which may be made from aluminum, promote greater cooling efficiency compared to a solid body. Fins 86 may comprise one or more of pin fins, straight fins (shown in FIG. 2), and flared fins. Referring to FIG. 4, which is an on-axis top plan view of pressure switch 10, connector 15 may be designed such that a maximum lateral extension profile 88 of connector 15 corresponds with a maximum lateral extension profile 90 of pressure switch 10. Thus, profile 88 may be commensurate with, such as equal in extension to, profile 90, or profile 88 may be smaller in extension than profile 90, such as is shown. Thus, the maximum lateral extension of a pressure switch 10 retrofitted with connector 15 may not be increased, or not substantially increased, which is advantageous when a pressure switch 10 is being retrofitted to fit within a tight space. Lateral extension may be determined relative to a pressure switch axis 94, for example.

Referring to FIG. 2, the effective extension length 76 may be tailored to a desired length. For example, a length 76 required to sufficiently reduce heat transfer in the desired application may be selected. A rod extension 36B of a length corresponding to the effective length 76 may be provided with connector 15. Thus, rod 36 may be effectively comprised of rod 36A and rod extension 36B connected together in use. Rod extension 36B may be located at least partially within the cylindrical connector 15. Rod extension 36B may be designed to have a rod end 80 and a switch end 82, rod end 80 being adapted to connect to a switch end 84 of rod 36A, while switch end 82 is adapted to operatively connect to switch 34. Rod extension 36B may be constructed from similar material as connector 15.

One or more heat insulating spacers 96 may at least partially surround the actuating rod 36 within interior bore 18 of the pressure switch 10. The addition of spacers 96, which may be made from an insulating material, will reduce the amount of convectional heat going up through the interior bore 18, thus decreasing the overall heat transfer to the switch housing 16. Referring to FIG. 3, spacers 96 may have an outwardly extending flange 98 adapted to fit in a corresponding groove 99 in the wall of interior bore 18. Spacers 96 may fully surround actuating rod 36, for example if spacers 96 are annular as shown, forming a tight fit that reduces convective heat transfer.

Materials used to construct connector 15 include aluminum in one embodiment. Connector 15 may comprise insulative material, such as high temperature resistant plastic. Although spool 14, switch housing 16, and cylindrical connector 15 are illustrated as separate pieces in one embodiment, collectively these pieces may be replaced in one embodiment by a housing 12 defining an interior bore 18 that terminates in a pressure sensitive end 20 of the housing 10. Fins 86 may be mounted on housing 12, for example between the switch 34 and actuating rod 36. Heat insulating spacer 96 may at least partially surround the actuating rod 36 within the internal bore 18 of housing 12. In one embodiment, housing 12 may be provided as a single unit.

Referring to FIG. 2, pressure sensitive end 20 of the spool 14 or housing 12 may be threaded into a conduit 97 such that the pressure sensitive end 20 is exposed to fluid pressure from fluids 95 within the conduit 97. Prior to installation in conduit 97, pressure switch 10 may be set to switch at, or selected to switch at, a predetermined external fluid pressure in conduit 97. Pressure switches 10 that switch under predetermined external fluid pressures in this fashion have numerous applications that need not be reiterated here.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A pressure switch comprising:

a spool forming a pressure sensitive end;

an actuating rod extended into the spool and slidable over a limited range within the pressure switch under external fluid pressure on the pressure sensitive end;

a switch housing containing a switch operatively connected to the actuating rod;

a cylindrical connector terminating in a first axial end and a second axial end, the cylindrical connector being threaded into the spool at the first axial end and into the switch housing at the second axial end; and outwardly extending fins mounted on the cylindrical connector.

2. The pressure switch of claim 1 in which the outwardly extending fins comprise one or more of pin fins, straight fins, and flared fins.

3. The pressure switch of claim 2 in which the outwardly extending fins comprise aluminum.

4. The pressure switch of claim 1 further comprising a heat insulating spacer at least partially surrounding the actuating rod within an interior bore of the pressure switch.

5. The pressure switch of claim 1 in which the actuating rod comprises a first rod and a rod extension longitudinally connected together, the rod extension being located at least partially within the cylindrical connector.

6. The pressure switch of claim 1 in which the pressure sensitive end of the spool is threaded into a conduit such that the pressure sensitive end is exposed to fluid pressure within the conduit.

7. A pressure switch comprising:

a housing defining an interior bore that terminates in a pressure sensitive end of the housing;

an actuating rod slidable over a limited range within the interior bore under external fluid pressure on the pressure sensitive end;

a switch, within the housing, operatively connected to the actuating rod; and a heat insulating spacer surrounding the actuating rod within the internal bore, the heat insulating spacer being annular and fully surrounding the actuating rod with a tight fit to reduce convective heat transfer.

8. A pressure switch comprising:

a spool forming a pressure sensitive end;

an actuating rod extended into the spool and slidable over a limited range within the pressure switch under external fluid pressure on the pressure sensitive end;

a switch housing containing a switch operatively connected to the actuating rod;

a cylindrical connector terminating in a first axial end and a second axial end, the cylindrical connector being threaded into the spool at the first axial end and into the switch housing at the second axial end;

outwardly extending fins mounted on the cylindrical connector; and a heat insulating spacer surrounding the actuating rod within an interior bore of the pressure switch, the heat insulating spacer being annular and fully surrounding the actuating rod with a tight fit to reduce convective heat transfer.

* * * * *